United States Patent [19]

Stine

[11] Patent Number: 4,574,339

[45] Date of Patent: Mar. 4, 1986

[54] INTERLOCKING LENS STRUCTURE FOR A SIGNAL LAMP

[75] Inventor: Harold R. Stine, Delta, Ohio

[73] Assignee: Fulton Industries, Inc., Wauseon, Ohio

[21] Appl. No.: 604,877

[22] Filed: Apr. 27, 1984

[51] Int. Cl.[4] ..... F21V 5/04

[52] U.S. Cl. ..... 362/360; 362/332

[58] Field of Search ..... 362/331, 332, 360

[56] References Cited

U.S. PATENT DOCUMENTS

| | | | |
|---|---|---|---|
| D. 153,942 | 5/1949 | Hussey . | |
| D. 216,151 | 11/1969 | Cox . | |
| D. 220,779 | 5/1971 | Garcia . | |
| 1,126,958 | 2/1915 | Crownfield | 362/360 |
| 2,246,320 | 6/1941 | Rolph | 362/331 |
| 2,496,482 | 2/1950 | Madan et al. | 362/360 |
| 2,841,697 | 7/1958 | Smith . | |
| 2,954,461 | 9/1960 | Tucker . | |
| 3,003,059 | 10/1961 | Worden | 362/332 |
| 3,803,402 | 4/1974 | Nasu . | |
| 3,803,403 | 4/1974 | Hasegawa . | |
| 4,462,068 | 7/1984 | Shadwick | 362/332 |

FOREIGN PATENT DOCUMENTS

| | | | |
|---|---|---|---|
| 0764984 | 3/1971 | Belgium | 362/332 |

*Primary Examiner*—Parshotam S. Lall

*Attorney, Agent, or Firm*—Marshall & Melhorn

[57] ABSTRACT

An interlocking lens structure comprising two opposed lens pieces is disclosed. Each of the lens pieces has a top portion including an edge having a first region formed with a groove and a second region formed with a projection. The first region of each of the lens pieces is adapted to mate with the second region of the other of the lens pieces. Each of the lens pieces further includes a side portion connected to the top portion and having two edges. One of the side portion edges is formed with a groove, while the other of the side portion edges is formed with a projection. The groove of each of the side portion edges is adapted to mate with the projection of the other of the side portion edges. The depth and the length of each of the groove/projection combinations can be varied to determine the amount of color separation between the lens pieces. The grooves and the projections also prevent light from escaping from the interior of the lens structure at the junction of the lens pieces.

13 Claims, 5 Drawing Figures

INTERLOCKING LENS STRUCTURE FOR A SIGNAL LAMP

BACKGROUND OF THE INVENTION

1. Field Of The Invention

The present invention relates in general to illumination devices and in particular to an interlocking lens structure for a signal lamp.

Combination lens structures for signal lamps are frequently used in automobiles and boats. Such structures are usually formed of two or more mating molded plastic lens pieces. The plastic lens pieces cannot be formed simultaneously as an integral combination lens structure because the lens pieces are usually formed of different colors. Therefore, combination lens structures of this kind have been produced by one of several complicated methods.

2. Description Of The Prior Art

U.S. Pat. No. 2,841,697 to Smith discloses a lamp having adjustable lamp shade sections. Each of the lamp shade sections includes a frame sector and a panel sector, the panel sector being supported by and disposed around the frame sector. The panel sectors include slidably interfitting side edge portions. Each of the lamp shade sections further includes a supporting rod connected to and supporting the frame sector thereof. Guide means are formed on a lamp standard for slidably receiving complementary portions of the supporting rods for slidably supporting the lamp shade sectors relative to the lamp standard.

U.S. Pat. No. 3,803,402 to Nasu discloses a lens structure for a combination signal lamp. The lens structure comprises at least two lens pieces, each having a sidewall to be joined together. Each sidewall has upper and lower edges and vertical side edges. The sidewall of one of the lens pieces has at least one exposed, vertical dovetail groove having first and second ends, the first end being opened, and a horizontal notch joining the open first end. The sidewall of the other lens piece has at least one vertical dovetail projection having first and second end surfaces located at a site corresponding to that of the groove formed on the one lens piece. The projection is provided with a configuration complementary to that of the groove. The sidewall of the other lens piece further includes a horizontal flange extending from the first surface and having a configuration complementary to that of the notch.

U.S. Pat. No. 3,803,403 to Hasegawa discloses a lens structure for a combination signal lamp. The lens structure comprises at least two lens pieces, each having a sidewall to be connected together. Each sidewall has horizontal upper and lower edges and bilateral peripheral margins extending vertically between the edges. The sidewall of one of the lens pieces has at least one exposed, vertical dovetail groove. The sidewall of the one lens piece further includes grooves formed on its bilateral peripheral margins, the inner surfaces thereof lying in the same plane of the innermost surface of the dovetail groove. The sidewall of the other lens piece has at least one vertical dovetail projection adapted to fit in the dovetail groove and ridges extending from its bilateral peripheral margins adapted to fit in the peripheral grooves.

Other lens structures are illustrated and described in U.S. Pat. Nos. 2,954,461 to Tucker, D153,942 to Hussey, D216,151 to Cox, and D220,779 to Garcia.

SUMMARY OF THE INVENTION

The present invention relates to an interlocking lens structure for a signal lamp comprising two opposed lens pieces forming a structure shaped like a cup having a closed end top portion connected to one end of a depending side portion, the other end of the side portion forming an open end of the structure. Each of the lens pieces has a section of the top portion including an edge having a first region formed with a groove and a second region formed with a projection. The first region of one of the lens pieces is adapted to mate with the second region of the other of the lens pieces and vice versa such that the two sections form the top portion of the structure.

Each of the lens pieces further includes a section of the side portion connected to the section of the top portion and having two edges extending from the section of the top portion to the open end of the structure. One of the side portion edges is formed with a groove, while the other of the side portion edges is formed with a projection. The groove of one of the side portion edges is adapted to mate with the projection of the other of the side portion edges and vice versa such that the two sections of the side portions form the side portion of the lens structure. The length and the depth of each groove/projection combination can be varied to determine the amount of separation between the different colors of the lens pieces.

It is an object of the present invention to provide a lens structure for a signal lamp which securely joins two interlocking lens pieces.

It is another object of the present invention to provide an interlocking lens structure which prevents leakage of light from the enclosed signal lamp.

It is a further object of the present invention to provide an interlocking lens structure which segregates the different colors of the lens pieces with a distinct line of color designation.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
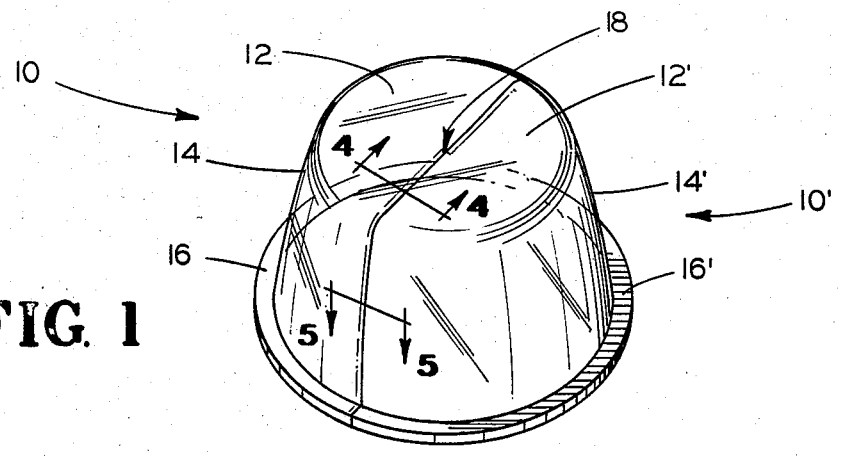
FIG. 1 is a perspective view of an interlocking lens structure for a signal lamp in accordance with the present invention.

Referring now to the drawings, there is illustrated in FIG. 1 an interlocking lens structure in accordance with the present invention. The interlocking lens structure includes two opposed lens pieces 10 and 10'. The lens pieces 10 and 10' are identical in construction, except that they are typically formed of different colored transparent plastic material. Accordingly, similar reference numerals, such as 10 and 10', will be utilized to denote the identical structures thereof throughout this description of the invention.

The lens pieces 10 and 10' include respective generally flat top portions 12 and 12' formed generally in the shape of a semicircle and having a curved periphery where the top portions join side portions 14 and 14' at one end thereof. An opposite end of side portions 14 and 14' forms an open end of the generally cup shaped lens structure and flat rim portions 16 and 16' extend outwardly from the side portions 14 and 14'. The rim portions 16 and 16' are adapted to be engaged by a coupler nut (not shown) or other means to secure the interlocking lens structure to a lamp standard supporting a light source (not shown) in a conventional manner.

Figure 2:
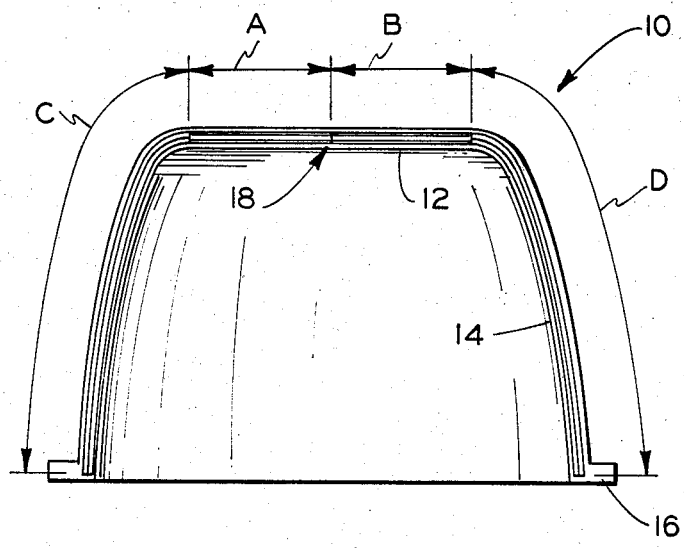
FIG. 2 is a side elevational view of one of the interlocking lens pieces illustrated in FIG. 1.

The structure of one of the lens pieces 10 is more clearly illustrated in FIG. 2. As shown therein, the edge of the flat top portion 12 is divided into two regions, identified as region A and region B. Regions A and B are separated by a center junction, indicated generally at 18. The structure of the center junction 18 is more clearly illustrated in FIG. 3. The edges of the side portion 14 are designated as region C and region D. As mentioned above, similar reference numerals will be utilized to denote identical regions of the lens pieces 10 and 10', such that regions A, B, C, and D of the one lens piece 10 correspond to regions A', B', C', and D' of the other lens piece 10'. Since the lens pieces 10 and 10' are adapted to fit together as illustrated in FIG. 1, it can be seen that region A of the one lens piece 10 mates with the region B' of the other lens piece 10' along the edge of the top portions 12 and 12' thereof and region B mates with region A' (not shown). Similarly, region C of the one lens piece 10 mates with region D' of the other lens piece 10' along the edge of the side portions 14 and 14' thereof and region D mates with region C' (not shown).

Figure 3:
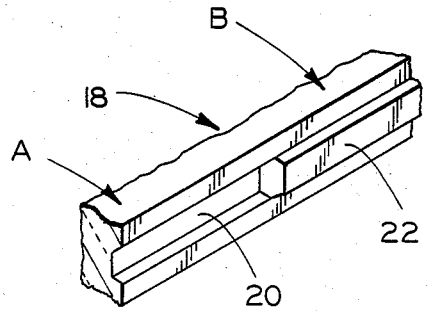
FIG. 3 is an enlarged perspective view, partially broken away, of the center junction of the lens piece illustrated in FIG. 2.
Figure 4:
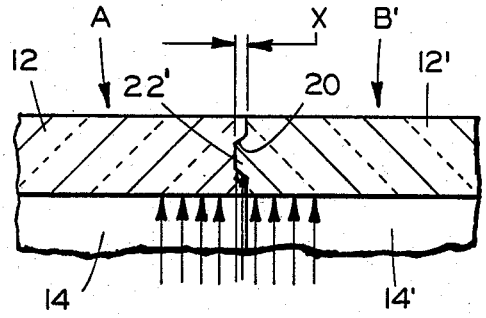
FIG. 4 is a sectional elevational view taken along line 4—4 of FIG. 1.

Referring now to FIGS. 3 and 4, the structures of regions A and B' of the top portions 12 and 12' are illustrated in detail. Region A of the one top portion 12 edge includes a groove 20 formed generally in the shape of a trapezoid and having a depth identified as X. Region B' of the other top portion 12' edge includes a complementarily-shaped projection 22' which is adapted to fit within the groove 20. The depth X defines a relatively narrow band when compared to the diameter of the surface of the top portions 12 and 12' wherein light generated by the light source in the direction of the arrows illustrated in FIG. 4 will be deflected away from said direction. Thus, a relatively small amount of light will be deflected as it passes through the top portions 12 and 12' near regions A and B' (and, consequently, also near regions A' and B), providing a relatively narrow band of color separation between the two top portions 12 and 12' by virtue of the groove 20 and the projection 22'.

Figure 5:
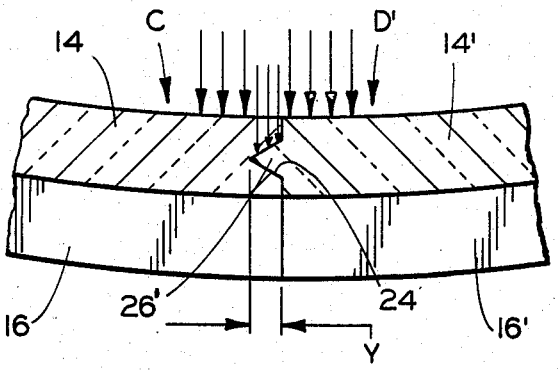
FIG. 5 is a sectional elevational view taken along line 5—5 of FIG. 1.

The structures of regions C and D' of the side portions 14 and 14' are illustrated in FIG. 5. As shown therein, region C of the one side portion 14 edge includes a groove 24 formed generally in the shape of a triangle and having a depth identified as Y. Similarly, region D' of the other side portion 14' edge includes a complementarily-shaped triangular projection 26' which is adapted to fit within the groove 24. The depth Y of the groove 24 is greater than the depth X of the groove 20, defining a relatively wide band wherein light generated by the light source in the direction of the arrows illustrated in FIG. 5 will be deflected away from said direction. Thus, a relatively larger amount of light will be deflected as it passes through the side portions 14 and 14' near regions C and D' (and, consequently, also near regions C' and D), providing a relatively wider band of color separation between the two side portions 14 and 14' by virtue of the groove 24 and the projection 26'.

In operation, the lens pieces 10 and 10' are mated as illustrated in FIG. 1 and disposed about the light source supported on a lamp standard. The rim portions 16 and 16' are secured to the lamp standard to maintain the lens portions 10 and 10' about the light source to form a protective enclosure therefor. When the top portions 12 and 12' of the lens structure are viewed, it will be seen that light will pass therethrough, while a relatively narrow band of color separation will be provided therebetween in the regions A, A', B and B'. When the side portions 14 and 14' of the lens structure are viewed, it will be seen that light will pass therethrough, while a relatively wider band of color separation will be provided therebetween in the regions C, C', D and D'. Thus, the bands define a color separation while they also prevent white light from escaping from the interior of the lens structure at the junction of the two lens pieces.

Although the lens structure is illustrated and described as comprising two opposed lens pieces 10 and 10', it must be understood that such lens structure can be formed of any number of lens pieces which are adapted to mate as described above. Furthermore, the length and the depth of each of the groove/projection combinations can be selected to predetermine the amount of color separation at the junction of the two lens pieces.

In accordance with the provisions of the patent statutes, the principle and mode of operation of the present invention have been explained and illustrated in its preferred embodiment. However, it must be appreciated that the present invention can be practiced otherwise than as specifically explained and illustrated without departing from its spirit or scope.

What is claimed is:

1. A lens piece adaptable for use in an interlocking lens structure comprising:

a top portion including an edge having a first region formed with a groove and a second region formed with a projection, said groove and projection of said top portion being complementary in dimensions; and a side portion connected to said top portion including two edges joining said edge of said top portion, one of said side portion edges formed with a groove and the other of said side portion edges formed with a projection, said groove and projection of said side portion being complementary in dimensions, the depth of said groove and projection of said top portion being different than the depth of said groove and projection of said side portion whereby two of the lens pieces interlock to form a lens structure.

2. The invention defined in claim 1 wherein said groove and said projection of said top portion are formed generally in the shape of a trapezoid.

3. The invention defined in claim 1 wherein said groove and said projection of said side portion are formed generally in the shape of a triangle.

4. The invention defined in claim 1 wherein said lens piece further includes a rim portion connected to said side portion and extending outwardly therefrom.

5. The invention defined in claim 1 wherein said top portion is formed generally in the shape of a semicircle and said side portion is connected to said top portion along a curved periphery thereof.

6. The invention defined in claim 5 wherein said top portion is generally flat and said groove and said projection of said top portion are formed along an edge thereof.

7. An interlocking lens structure comprising two opposed mating lens pieces, each of said lens pieces having:

a top portion including an edge having a first region formed with a groove and a second region formed with a projection, said first region of each of said lens pieces adapted to mate with said second region of the other of said lens pieces; and a side portion connected to said top portion including two edges, one of said side portion edges formed with a groove and the other of said side portion edges formed with a projection, said groove of each of said lens pieces adapted to mate with said projection of the other of said lens pieces.

8. The invention defined in claim 7 wherein said grooves and said projections of said top portions are formed generally in the shape of a trapezoid.

9. The invention defined in claim 7 wherein said grooves and said projections of said side portions are formed generally in the shape of a triangle.

10. The invention defined in claim 7 further including respective rim portions connected to said side portions and extending outwardly therefrom.

11. The invention defined in claim 7 wherein said top portions are each formed generally in the shape of a semicircle and said side portions are each connected to said top portions along curved edges thereof.

12. The invention defined in claim 7 wherein said grooves and said projections of said top portions are different in depth than said grooves and said projections of said side portions.

13. The invention defined in claim 7 wherein said grooves and said projections of said side portions are different in length than said grooves and said projections of said top portions.

* * * * *